US010002556B2

(12) United States Patent
Matsuyama et al.

(10) Patent No.: US 10,002,556 B2
(45) Date of Patent: Jun. 19, 2018

(54) DISPLAY CONTROL TO ALLEVIATE TRANSITION OF PIXEL TO AN UNDESIRED LEVEL OF GRADATION OVER TIME

(71) Applicant: SONY CORPORATION, Tokyo (JP)

(72) Inventors: Eisuke Matsuyama, Kanagawa (JP); Keisuke Hashimoto, Kanagawa (JP); Yoko Uto, Tokyo (JP); Takeshi Furusho, Tokyo (JP)

(73) Assignee: SONY CORPORATION, Tokyo (JP)

( * ) Notice: Subject to any disclaimer, the term of this patent is extended or adjusted under 35 U.S.C. 154(b) by 89 days.

(21) Appl. No.: 14/779,190

(22) PCT Filed: Mar. 19, 2014

(86) PCT No.: PCT/JP2014/001567

§ 371 (c)(1),
(2) Date: Sep. 22, 2015

(87) PCT Pub. No.: WO2014/156063

PCT Pub. Date: Oct. 2, 2014

(65) Prior Publication Data

US 2016/0055787 A1 Feb. 25, 2016

(30) Foreign Application Priority Data

Mar. 29, 2013 (JP) ..... 2013-074579

(51) Int. Cl.
*G09G 3/20* (2006.01)
*G09G 3/34* (2006.01)

(52) U.S. Cl.
CPC ..... *G09G 3/2007* (2013.01); *G09G 3/344* (2013.01); *G09G 2300/0473* (2013.01); *G09G 2320/0257* (2013.01); *G09G 2320/0271* (2013.01); *G09G 2320/041* (2013.01); *G09G 2320/048* (2013.01); *G09G 2320/0626* (2013.01); *G09G 2330/021* (2013.01); *G09G 2380/14* (2013.01)

(58) Field of Classification Search
CPC ..... G09G 3/2007; G09G 2320/041; G09G 2320/0626; G09G 2320/0257; G09G 2320/0271; G09G 2320/048; G09G 2380/14; G09G 3/344; G09G 2330/021; G09G 2300/0473
See application file for complete search history.

(56) References Cited

U.S. PATENT DOCUMENTS

2005/0001812 A1 1/2005 Amundson et al.
2009/0231266 A1 9/2009 Lee et al.
2011/0234557 A1 9/2011 Yang et al.
2013/0120473 A1* 5/2013 Yamada ..... G09G 3/34 345/690
2013/0194250 A1* 8/2013 Amundson ..... G09G 3/344 345/107

FOREIGN PATENT DOCUMENTS

JP 2005-509925 A 4/2005

* cited by examiner

*Primary Examiner* — Abhishek Sarma
(74) *Attorney, Agent, or Firm* — Chip Law Group

(57) ABSTRACT

A device includes circuitry that determines a currently defined tone of a pixel, and that determines a voltage to be applied to the pixel to compensate for a change in tone of the pixel through elapsed time based on the currently defined tone of the pixel. The device then applies the voltage to the pixel.

22 Claims, 12 Drawing Sheets

DISPLAY CONTROL TO ALLEVIATE TRANSITION OF PIXEL TO AN UNDESIRED LEVEL OF GRADATION OVER TIME

TECHNICAL FIELD

The present technology relates to a display control apparatus, a display control method, and an electronic information display apparatus, and more particularly, to a display control apparatus, a display control method, and an electronic information display apparatus capable of alleviating a phenomenon that a pixel transits to an undesired level of gradation due to change over time.

CROSS REFERENCE TO RELATED APPLICATIONS

This application claims the benefit of Japanese Priority Patent Application JP 2013-074579, filed on Mar. 29, 2013, the entire contents of which are incorporated herein by reference.

BACKGROUND ART

In recent years, electronic book readers are becoming widely prevalent. As opposed to a liquid crystal display, a bi-stable electro-optical display used as a display of an electronic book reader does not require any backlight, and consumes power only when the contents on the screen are changed, and the bi-stable electro-optical display can turn off the power except when the contents on the screen are changed, and therefore, the bi-stable electro-optical display has an advantage in that it consumes small electric power (for example, see PTL 1).

CITATION LIST

Patent Literature

[PTL 1]
Japanese Translation of PCT International Application No. 2005-509925

SUMMARY OF INVENTION

Technical Problem

However, when the material in the pixel is not stable enough in the bi-stable electro-optical display, the level of gradation may change toward the half tone as the time passes, and it may transit to a level of gradation that is not desired.

More specifically, as illustrated in FIG. 1, immediately after drawing, in a black pixel of which level of gradation is the lowest, the brightness increases as a certain period of time passes, and in a white pixel of which level of gradation is the highest, the brightness decreases as a certain period of time passes. In addition, in a pixel of gray scale, the level of gradation changes to the half tone as a certain period of time passes.

Because of the change of the level of gradation due to the elapse of the time as described above, the phenomenon as illustrated in FIG. 2 occurs.

More specifically, suppose that, as illustrated in a screen P1 of FIG. 2, at a certain drawing time, a region R1 in a central portion of the entire portion of the display is painted in black, and a region R2 other than that is painted in white.

As the time passes since the screen P1 is drawn, the brightness decreases in the region R2 and the white gradually changes to gray as shown in a screen P2. On the other hand, as the time passes, the brightness increases in the region R1, and the black gradually changes to gray.

Then, for example, suppose that, a user performs operation for turning a page to a subsequent page, thus executing drawing of image data to make the region R1 white. In this case, originally, both of the region R1 and the region R2 are regions painted in the same white, and therefore, both of the region R1 and the region R2 should be perceived as white. However, the level of gradation of the region R2 which has not yet drawn and updated changes to gray as the time passes, and accordingly, as illustrated in a screen P3, this makes difference in the level of gradation between the region R1 and the region R2. Like this region R2, due to the change of the level of gradation that occurs due to the elapse of the time, an area ghost, which is a false region that should not be recognized, may occur.

In the past, in order to remove such area ghost, control has been performed to give driving pulse for instantly reversing white and black in each pixel, which is called flash, but this makes white/black reversal conspicuous, and therefore, it is desired to alleviate the change the level of gradation that occurs with the elapse of time without doing flashing.

The present technology has been made in view of such circumstances, and it is an object of the present technology to alleviate a phenomenon, e.g., area ghost, that a pixel transits to an undesired level of gradation due to change over time.

Solution to Problem

In a first exemplary aspect, a device includes circuitry that determines a currently defined tone of a pixel, and that determines a voltage to be applied to the pixel to compensate for a change in tone of the pixel through elapsed time based on the currently defined tone of the pixel. The device then applies the voltage to the pixel.

In a second exemplary aspect, a method for removing an area ghost in a display of an apparatus, includes determining a currently defined tone of a pixel, and determining a voltage to be applied to the pixel to compensate for a change in tone of the pixel through elapsed time based on the currently defined tone of the pixel. The method also includes applying the voltage to the pixel.

In a third exemplary aspect, a non-transitory computer-readable medium encoded with computer-readable instructions thereon, the computer-readable instructions when executed by a computer cause the computer to perform a method that includes determining a currently defined tone of a pixel, and determining a voltage to be applied to the pixel to compensate for a change in tone of the pixel through elapsed time based on the currently defined tone of the pixel. The method also includes applying the voltage to the pixel.

Advantageous Effects of Invention

According to the first to the third aspects of the present technology, it is possible to alleviate a phenomenon that a pixel transits to an undesired level of gradation due to change over time.

DESCRIPTION OF EMBODIMENTS

<Block Diagram of Electronic Book Reader>

Figure 3:
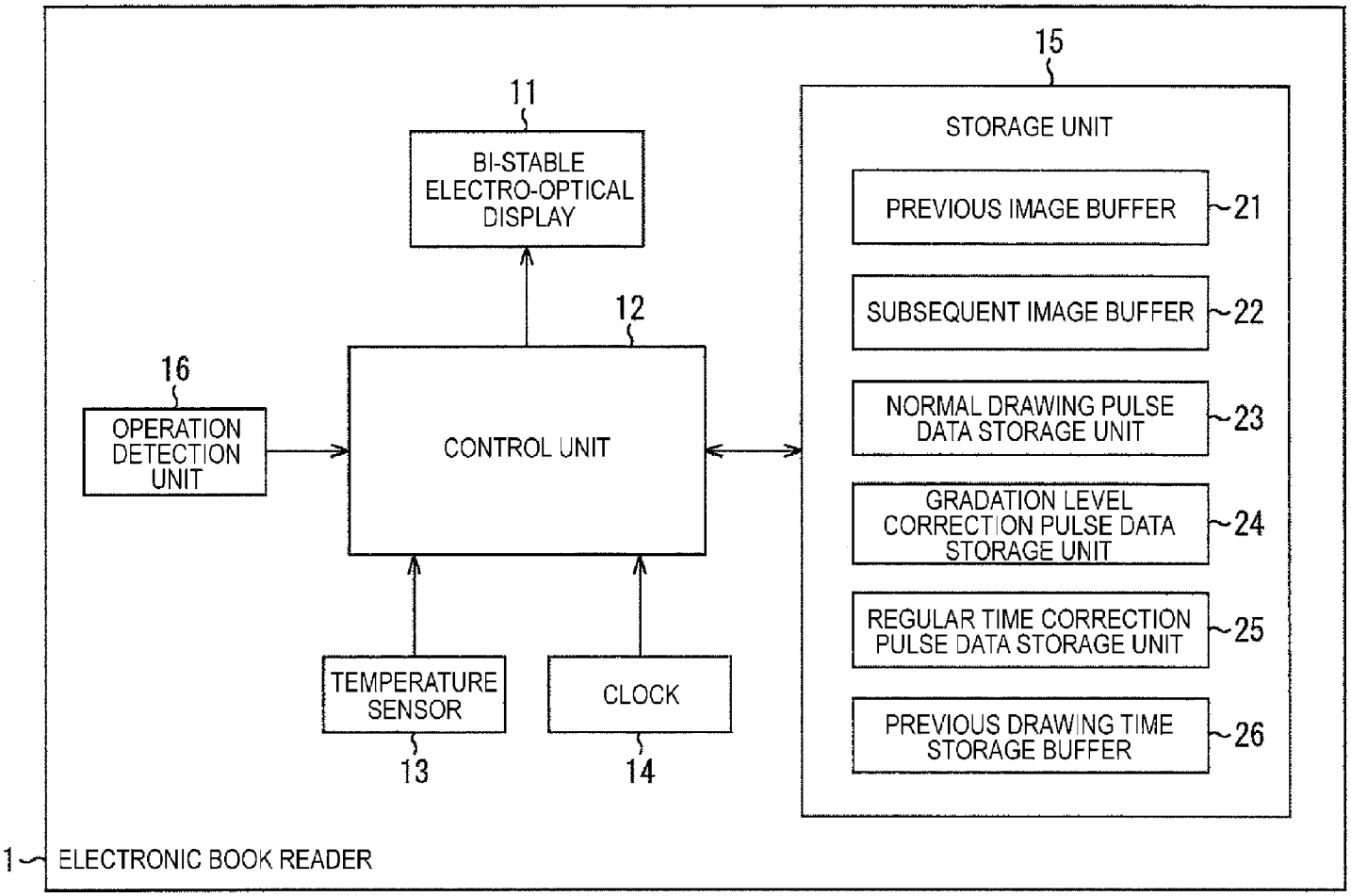
FIG. 3 is a block diagram illustrating an example of configuration of an embodiment of an electronic book reader to which the present technology is applied.

FIG. 3 is a block diagram illustrating an example of configuration of an embodiment of an electronic book reader to which the present technology is applied, and illustrates a functional configuration block diagram of display control of the electronic book reader.

The electronic book reader 1 of FIG. 3 includes a bi-stable electro-optical display 11 serving as a display panel, and includes a control unit 12 serving as a display control unit therefor. In addition, the electronic book reader 1 includes a temperature sensor 13, a clock 14, a storage unit 15, and an operation detection unit 16. In general, the bi-stable electro-optical display 11 is also called electronic paper, and the electronic book reader 1 is a kind of electronic information display apparatus using electronic paper as a display medium.

The bi-stable electro-optical display 11 is configured such that single or multiple particles are mixed in an intermediate layer between a back surface electrode and a front surface electrode (transparent electrode) at a display surface side.

For example, in the bi-stable electro-optical display 11 in which white particles and black particles exist in a mixed manner, when, for example, a positive voltage (for example, +15 V) is applied to the back surface electrode with the driving pulse control of the control unit 12, white particles gather to the front surface electrode side at the display surface side, and the black particles gather to the back surface electrode side, so that white (color) is displayed. On the contrary, when a negative voltage (for example, −15 V) is applied to the back surface electrode, black particles gather to the front surface electrode side at the display surface side, and white particles gather to the back surface electrode side, so that black (color) is displayed. It should be noted that a voltage (common voltage) unique to the display panel is applied to the front surface electrode (transparent electrode).

The bi-stable electro-optical display 11 has, for example, a predetermined resolution such as SVGA (800*600), and can display white, black, and gray, which is the half tone between black and white in units of pixels arranged in a matrix form. In the present embodiment, the bi-stable electro-optical display 11 is considered to be able to display monochrome gradation in sixteen levels, in which the level of gradation 15 of which brightness is the highest is referred to as white, the level of gradation 0 of which brightness is the lowest is referred to as black, and the levels of gradation 1 to 14 between the white and the black are referred to as grays 1 to 14. In the explanation below, the bi-stable electro-optical display 11 will be simply referred to as a display 11.

The control unit 12 outputs predetermined driving pulse to the display 11 on the basis of a temperature detected by the temperature sensor 13, a time (count value) detected by the clock 14, and image data and driving control data stored in the storage unit 15, thus controlling the level of gradation of each pixel of the display 11. In addition, the control unit 12 controls whether power supply is to be provided to the display 11 (ON, OFF). Therefore, control unit 12 functions as a display control apparatus for performing display control of the display 11.

The control unit 12 can be constituted by hardware such as a CPU (Central Processing Unit), ROM (Read Only Memory), and RAM (Random Access Memory), and can achieve the display control explained below by executing the control program stored in the ROM and the like. The control unit 12 may also be configured as a control IC (Integrated Circuit) and a control LSI (Large Scale Integration), or may be configured as a single chip (SoC: System-on-a-chip) together with the storage unit 15.

The temperature sensor 13 detects the current temperature around the display 11, and outputs the detection result to the control unit 12.

The clock 14 outputs the count value representing the current time to the control unit 12 on the basis of a predetermined master clock signal.

The storage unit 15 stores data required for display control of the display with the control unit 12. The storage unit 15 is constituted by hardware such as ROM, RAM, and the like.

The storage unit 15 includes a previous image buffer 21, a subsequent image buffer 22, a normal drawing pulse data storage unit 23, a gradation level correction pulse data storage unit 24, a regular time correction pulse data storage unit 25, and a previous drawing time storage buffer 26.

The previous image buffer 21 stores image data of a predetermined page of an electronic book currently displayed on the display 11 (hereinafter referred to as a current page). The subsequent image buffer 22 stores image data of page subsequent to the current page. More specifically, when a user performs operation to turn a page when any given page of a predetermined electronic book (content data) stored in the content storage unit, not shown, of the electronic book reader 1 is displayed on the display 11, image data of the electronic book stored in the subsequent image buffer 22 is displayed.

In the explanation below, image data for one page of an electronic book displayed on the display 11 will also be referred to as page data.

The normal drawing pulse data storage unit 23 stores driving pulse data for drawing pixels where the level of gradation is to be changed when, for example, a user commands to turn the page and the screen is updated.

The gradation level correction pulse data storage unit 24 stores driving pulse data for drawing pixels where the level of gradation is not to be changed when, for example, a user commands to turn the page and the screen is updated.

In other words, the gradation level correction pulse data storage unit 24 stores driving pulse data for correcting the level of gradation due to change over the elapse of time for pixels where the level of gradation is not to be changed even when the page is turned and the image data is changed.

The regular time correction pulse data storage unit 25 stores driving pulse data for correcting the level of gradation due to change over the elapse of time where the user does not command to, e.g., turn the page, for a certain period of time and the screen is to be transited for a certain period of time or more.

In the present embodiment, a case where the user performs operation to turn the page and the entire screen is drawn in order to display the image of the subsequent page will be explained as an example where the screen is updated, but as explained later, the present technology can also be applied to screen updating other than turning the page.

The previous drawing time storage buffer 26 stores the last time (the latest time) when the display 11 was drawn (the display is updated).

The operation detection unit 16 detects operation performed by the user, and provides a control signal corresponding to the detected operation to the control unit 12. For example, when the operation detection unit 16 detects page turning operation that is performed by the user, the operation detection unit 16 provides the control unit with a drawing request for displaying a subsequent page.

<Example of Storage Data of Normal Drawing Pulse Data Storage Unit>

Figure 4:
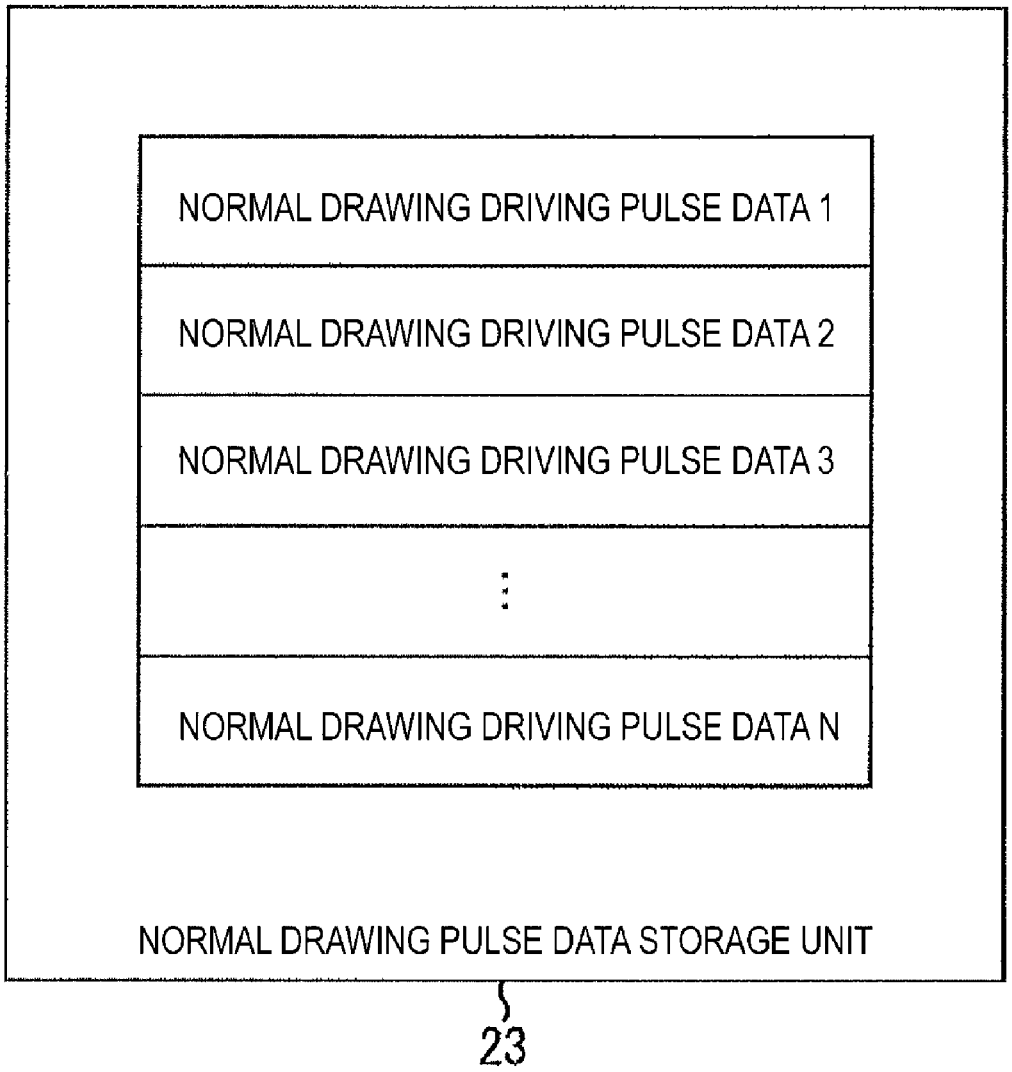
FIG. 4 is a figure illustrating an example of driving data of a normal drawing pulse data storage unit.

FIG. 4 illustrates an example of driving data stored in the normal drawing pulse data storage unit 23.

The normal drawing pulse data storage unit 23 stores multiple (N) normal drawing driving pulse data 1 to normal drawing driving pulse data N, which are driving pulse data used for pixels where the level of gradation is to be changed in response to change of the page data.

Each of the multiple normal drawing driving pulse data 1 to normal drawing driving pulse data N is defined by a combination of a voltage value (application voltage) applied to the back surface electrode and a frequency (application frequency) at which the voltage value is applied. The application voltage corresponds to the height of the driving pulse. The application frequency corresponds to the length (width) of the driving pulse. For example, when the white is displayed, the application voltage is +15 V, and when the black is displayed, the application voltage is −15 V. When the amplitude of the driving pulse is zero, the common voltage unique to the display panel that is the same as that of the front surface electrode is applied to the back surface electrode. The application frequency is set by the number of frames applied for drawing and updating.

For example, the normal drawing driving pulse data 1 is defined to apply an application voltage +15 V over five frames (5 times) and apply −15 V over three frames (3 times), and the normal drawing driving pulse data 2 is defined to apply an application voltage +15 V over ten frames (ten times), and apply −15 V over five frames (5 times).

The control unit 12 selects any one of the normal drawing driving pulse data 1 to normal drawing driving pulse data N on the basis of the current temperature detected by the temperature sensor 13, the level of gradation before the drawing target pixel is updated, and the level of gradation after the level of gradation is updated, and applies a driving pulse (driving voltage) corresponding to the selected normal drawing driving pulse data.

It should be noted that the normal drawing pulse data storage unit 23 can register not only the temperature, the level of gradation before the drawing target pixel is updated, and the level of gradation after the level of gradation is updated, but also, many normal drawing driving pulse data which are more finely divided in accordance with, for example, the display mode, the drawing quality setting, and the drawing speed setting designated by the user. In this case, the control unit 12 can select a predetermined normal drawing driving pulse data from among many normal drawing driving pulse data stored in the normal drawing pulse data storage unit 23 in accordance with the condition having been set, and can perform the driving control.

<Example of Stored Data in Gradation Level Correction Pulse Data Storage Unit>

Figure 5:
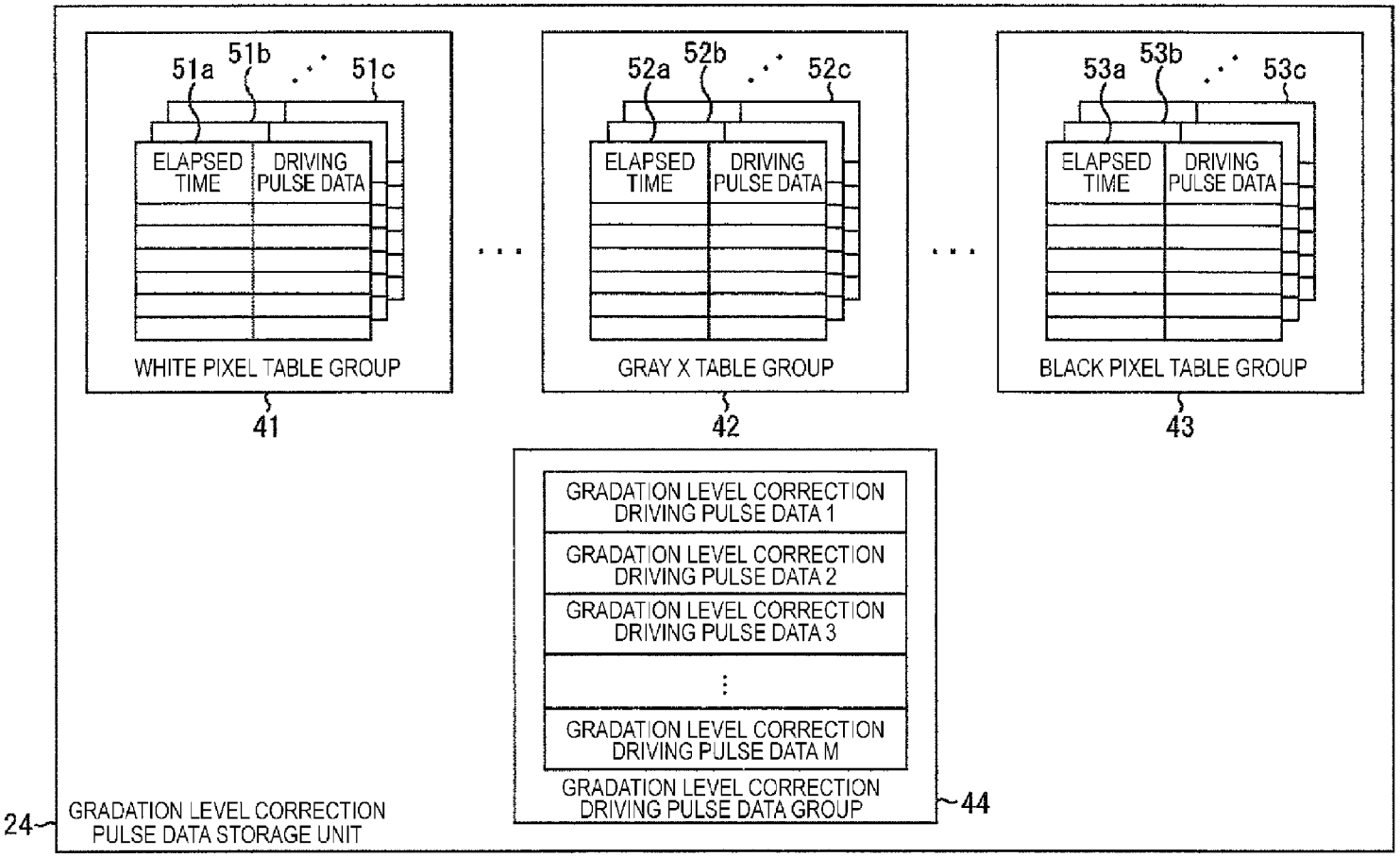
FIG. 5 is a figure illustrating an example of driving pulse data of a gradation level correction pulse data storage unit.

FIG. 5 illustrates an example of driving pulse data stored in the gradation level correction pulse data storage unit 24.

The gradation level correction pulse data storage unit 24 includes a white pixel table group 41, a gray X table group 42, a black pixel table group 43, and a gradation level correction driving pulse data group 44.

The white pixel table group 41 stores driving pulse data for drawing pixels of which level of gradation is not changed even when the page data is changed and which are used in a case where the level of gradation of the drawing target pixel is white.

The white pixel table group 41 stores, for each predetermined temperature, a white pixel time-pulse correspondence table 51 in which an elapsed time since the latest drawing update and driving pulse data corresponding to the elapsed time are associated. In other words, the white pixel table group 41 includes multiple white pixel time-pulse correspondence tables 51*a*, 51*b*, 51*c* . . . in association with the temperature detected by the temperature sensor 13.

The gray X table group 42 stores driving pulse data which are for drawing pixels of which level of gradation is not to be changed even when page data is changed and which are used in a case where the level of gradation of the drawing target pixel is gray X.

The gray X table group 42 stores, for each predetermined temperature, a gray X time-pulse correspondence table 52 in which the elapsed time since drawing and updating are performed last time and driving pulse data corresponding to the elapsed time are associated with each other. In other words, the gray X table group 42 includes multiple gray X time-pulse correspondence tables 52*a*, 52*b*, 52*c* . . . in association with the temperature detected by the temperature sensor 13.

It should be noted that the gray X may be any one of the level of gradation 1 to the level of gradation 14, or two or more of the level of gradation 1 to the level of gradation 14. In other words, the gradation level correction pulse data storage unit 24 can store the gray X table group 42 with regard to the level of gradation X which is any one of the gray 1 to the gray 14.

The black pixel table group 43 stores driving pulse data which are for drawing pixels of which level of gradation is not to be changed even when page data is changed and which are used in a case where the level of gradation of the drawing target pixel is black.

The black pixel table group 43 stores, for each predetermined temperature, a black pixel time-pulse correspondence table 53 in which the elapsed time since drawing and updating are performed last time and driving pulse data corresponding to the elapsed time are associated with each other. In other words, the black pixel table group 43 includes multiple black pixel time-pulse correspondence tables 53*a*, 53*b*, 53*c* . . . in association with the temperature detected by the temperature sensor 13.

The gradation level correction driving pulse data group 44 stores multiple (M) gradation level correction driving pulse data 1 to M which are specific driving pulse data used for pixels of which level of gradation is not to be changed even when page data is changed. Each of multiple gradation level correction driving pulse data 1 to M is defined by a combination of an application voltage and an application frequency like the normal drawing driving pulse data.

Each of the driving pulse data, i.e., the white pixel time-pulse correspondence table 51, the gray X time-pulse correspondence table 52, and the black pixel time-pulse correspondence table 53 describes a value representing any one of gradation level correction driving pulse data 1 to M of the gradation level correction driving pulse data group 44 (the number of gradation level correction driving pulse data). Therefore, multiple gradation level correction driving pulse data 1 to M of the gradation level correction driving pulse data group 44 are shared by the white pixel time-pulse correspondence table 51, the gray X time-pulse correspondence table 52, and the black pixel time-pulse correspondence table 53.

<Example of Data Stored in Regular Time Correction Pulse Data Storage Unit>

Figure 6:
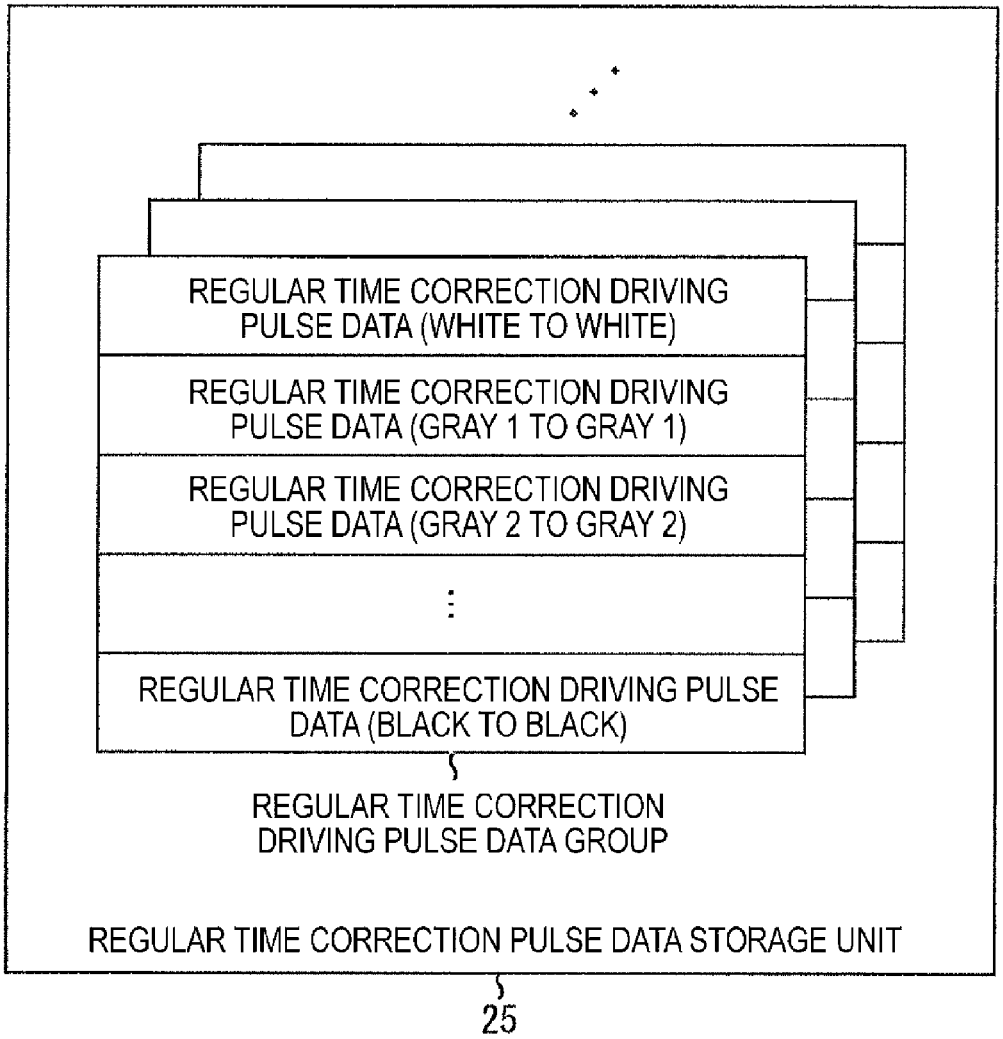
FIG. 6 is a figure illustrating an example of driving pulse data of a regular time correction pulse data storage unit.

FIG. 6 illustrates an example of driving pulse data stored in the regular time correction pulse data storage unit 25.

The regular time correction pulse data storage unit 25 stores, for each predetermined temperature, regular time correction driving pulse data group for correcting the level of gradation due to change over the elapse of time when the screen is to be transited for a predetermined period of time or more.

One regular time correction driving pulse data group corresponding to a predetermined temperature includes regular time correction driving pulse data (white to white), regular time correction driving pulse data (gray 1 to gray 1), regular time correction driving pulse data (gray 2 to gray 2), . . . , and regular time correction driving pulse data (black to black).

The regular time correction driving pulse data (white to white) is driving pulse data for correcting the level of gradation due to change over the elapse of time for pixels of which the current level of gradation is white.

The regular time correction driving pulse data (gray 1 to gray 1) is driving pulse data for correcting the level of gradation due to change over the elapse of time for pixels of which current level of gradation is gray 1.

The regular time correction driving pulse data (gray 2 to gray 2) is driving pulse data for correcting the level of gradation due to change over the elapse of time for pixels of which current level of gradation is gray 2.

The regular time correction driving pulse data (gray 3 to gray 3) to the regular time correction driving pulse data (gray 14 to gray 14) are also the same.

The regular time correction driving pulse data (black to black) is driving pulse data for correcting the level of gradation due to change over the elapse of time for pixels of which current level of gradation is black.

It should be noted that, in the present embodiment, driving pulse data for correcting the level of gradation due to change over the elapse of time are provided for all of the sixteen levels of gradation that can be displayed by the display 11. However, in a case where the levels of gradation of correction target are only some of the levels of gradation, it may be possible to omit driving pulse data of the levels of gradation other than the correction target.

<Explanation About Area Ghost Removing Processing When Turning Page>

The area ghost removing processing when turning page that is performed by the control unit 12 will be hereinafter explained with FIG. 7.

Figure 7:
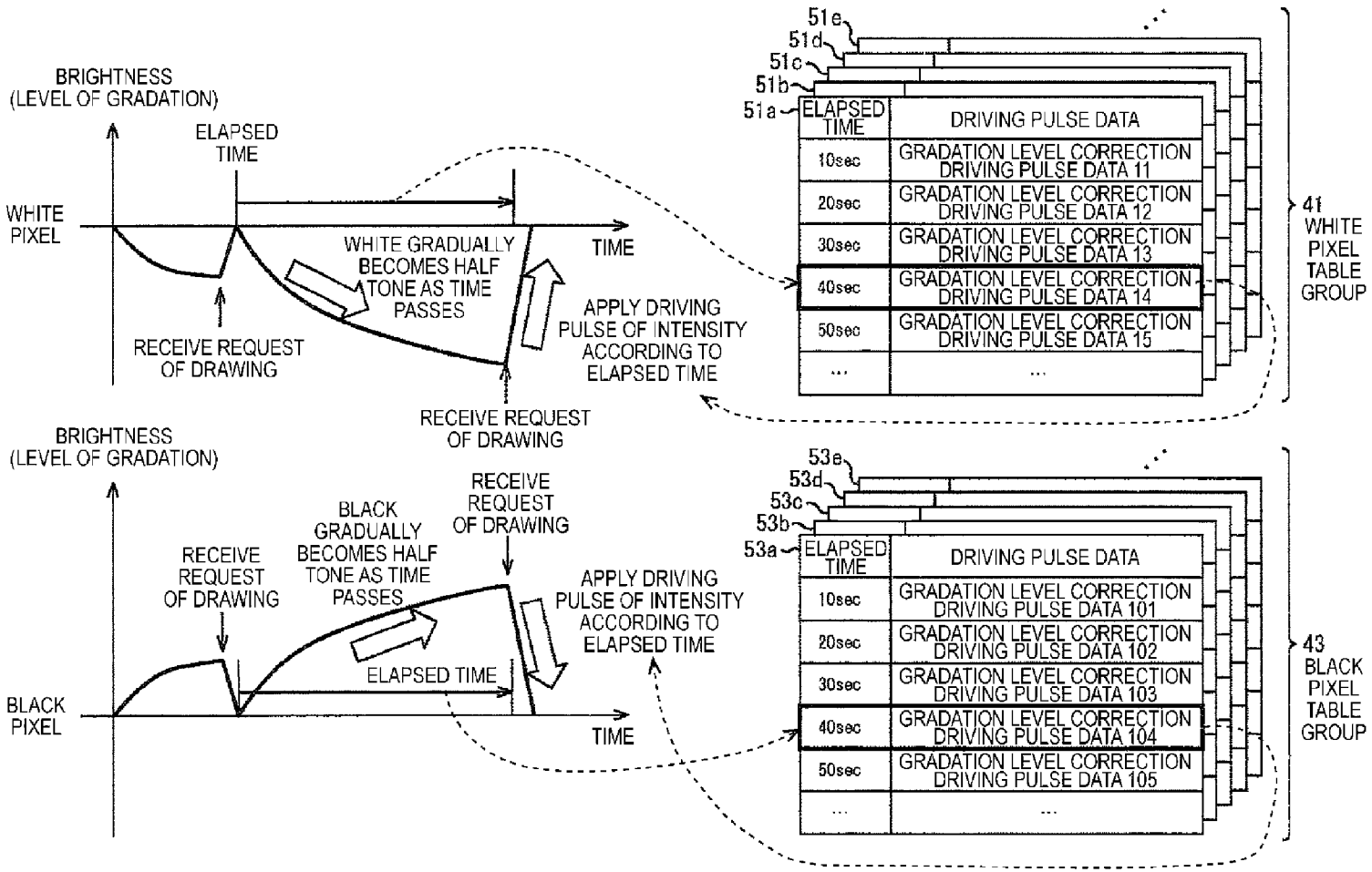
FIG. 7 is a figure for explaining area ghost removing processing when a page is turned.

The figure at the upper side of FIG. 7 illustrates an example of area ghost removing processing in a case where a pixel of which level of gradation is not to be changed even when page data is changed is a white pixel.

In the white pixel, when drawing is not updated, the brightness gradually decreases to reach the half tone as the time passes.

When the operation detection unit 16 provides request of drawing of a subsequent page, the control unit 12 obtains a previous drawing time stored in the previous drawing time storage buffer 26, and calculates the elapsed time since the previous drawing.

In addition, the control unit 12 obtains the current temperature which is output from the temperature sensor 13, and selects the white pixel time-pulse correspondence table 51*a* corresponding to the obtained temperature from among multiple white pixel time-pulse correspondence tables 51*a*, 51*b*, 51*c* . . . of the white pixel table group 41.

Then, the control unit 12 selects the gradation level correction driving pulse data corresponding to the calculated elapsed time from among the selected white pixel time-pulse correspondence table 51*a*. For example, as illustrated in FIG. 7, when the calculated elapsed time is 40 seconds, the gradation level correction driving pulse data 14 is selected. Subsequently, the control unit 12 refers to the gradation level correction driving pulse data 14 of the gradation level correction driving pulse data group 44, and applies the driving pulse. Accordingly, the driving pulse of the intensity according to the elapsed time since the previous drawing is applied, and this can correct the decrease of the level of gradation according to the elapsed time.

The figure at the lower side of FIG. 7 illustrates an example of area ghost removing processing in a case where a pixel of which level of gradation is not to be changed even when page data is changed is a black pixel.

In the black pixel, when drawing is not updated, the brightness gradually increases to reach the half tone as the time passes.

When the operation detection unit 16 provides request of drawing of a subsequent page, the control unit 12 obtains a previous drawing time stored in the previous drawing time storage buffer 26, and calculates the elapsed time since the previous drawing.

In addition, the control unit 12 obtains the current temperature which is output from the temperature sensor 13, and selects the black pixel time-pulse correspondence table 53*a* corresponding to the obtained temperature from among multiple black pixel time-pulse correspondence tables 53*a*, 53*b*, 53*c* . . . of the black pixel table group 43.

Then, the control unit 12 selects the gradation level correction driving pulse data 104 corresponding to the calculated elapsed time from among the selected black pixel time-pulse correspondence table 53*a*, refers to the gradation level correction driving pulse data 104 of the gradation level correction driving pulse data group 44, and applies the driving pulse. Accordingly, the driving pulse of the intensity according to the elapsed time since the previous drawing is applied, and this can correct the increase of the level of gradation according to the elapsed time.

The processing in a case of gray X is the same as the processing for the white pixel and the black pixel explained above.

<Processing Flow of First Area Ghost Removing Processing>

Subsequently, the first area ghost removing processing will be explained with reference to the flowchart of FIG. 8.

Figure 8:
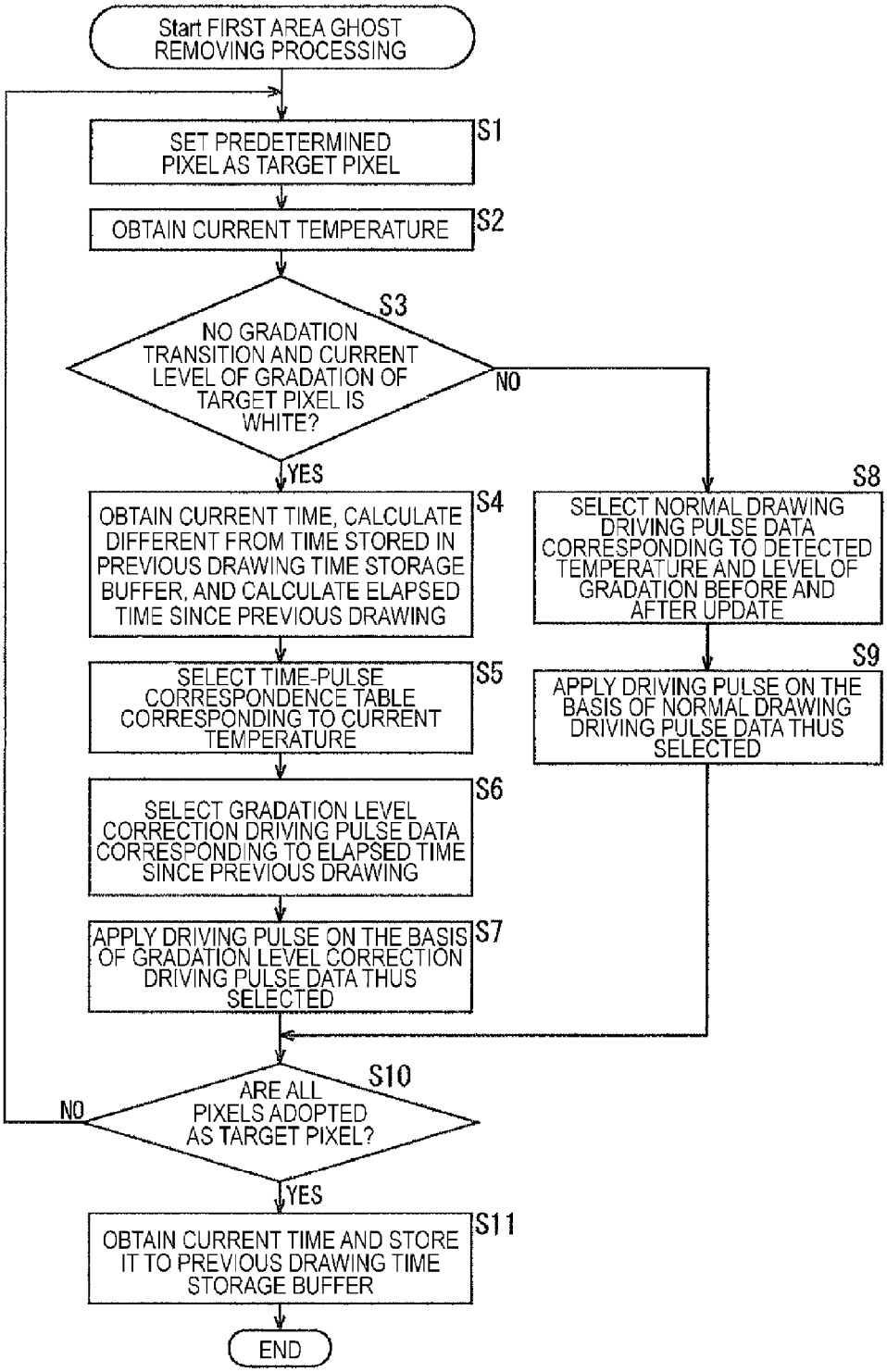
FIG. 8 is a flowchart for explaining first area ghost removing processing.

The first area ghost removing processing of FIG. 8 is processing for performing the area ghost removing processing only on white pixels of pixels of which level of gradation is not to be changed even when page data is changed.

This processing is executed in a case where, for example, the operation detection unit 16 provides request of drawing. In the explanation below, suppose that a user performs operation to turn a page, and the operation detection unit 16 provides a request of drawing for updating a page.

First, in step S1, the control unit 12 sets a predetermined pixel of all the pixels of the display 11 as a target pixel which is a pixel of drawing target.

In step S2, the control unit 12 obtains the current temperature detected by the temperature sensor 13.

In step S3, on the basis of the image data stored in the subsequent image buffer 22, the control unit 12 determines whether the level of gradation of the target pixel is to be transited between the current page and the subsequent page and the current level of gradation of the target pixel is white.

When the level of gradation of the target pixel is not determined to transit and the current level of gradation of the target pixel is determined to be white in step S3, subsequently the processing in step S4 is performed.

In step S4, the control unit 12 obtains the current time from the clock 14, calculates difference from the time stored in the previous drawing time storage buffer 26, and calculates the elapsed time since the previous drawing.

In step S5, the control unit 12 selects the white pixel time-pulse correspondence table 51 corresponding to the obtained current temperature from among the white pixel table group 41.

In step S6, the control unit 12 selects the gradation level correction driving pulse data corresponding to the elapsed time since the previous drawing from the selected white pixel time-pulse correspondence table 51.

In step S7, the control unit 12 applies the driving pulse to the target pixel on the basis of the selected gradation level correction driving pulse data. After step S7, subsequently the processing in step S10 is performed.

On the other hand, when the level of gradation of the target pixel is determined to have transited or the current level of gradation of the target pixel is determined not to be white in step S3 explained above, subsequently the processing in step S8 is performed.

In step S8, the control unit 12 selects any one of the normal drawing driving pulse data 1 to normal drawing driving pulse data N, on the basis of the obtained current temperature, the level of gradation of the target pixel before update, and the level of gradation after update.

Then, in step S9, the control unit 12 applies the driving pulse corresponding to the selected normal drawing driving pulse data to the target pixel. Thereafter, the processing in step S10 is performed.

In step S10, the control unit 12 determines whether all the pixels of the display 11 are set as the target pixel.

When all the pixels are determined not to have been set as the target pixel in step S10, the flow returns back to the processing in step S1, and the processing in steps S1 to S10 explained above are repeated. More specifically, when a subsequent pixel that has not yet been set as the target pixel is set as the target pixel, and the level of gradation of the target pixel is not to be transited, and the level of gradation is white, then, the control is executed to apply the driving pulse according to the elapsed time since the previous drawing.

On the other hand, when all the pixels are determined to have been set as the target pixel in step S10, subsequently the processing in step S11 is performed, and the control unit 12 obtains the current time from the clock 14, and stores it to the previous drawing time storage buffer 26, and the processing is terminated.

As described above, according to the first area ghost removing processing, each pixel of the display 11 is set as the target pixel, and when the level of gradation is to be transited on the basis of the pixel data of a page displayed subsequently, the driving pulse corresponding to the normal drawing driving pulse data is applied to the target pixel.

On the other hand, when the level of gradation of the target pixel is not to be transited, and the level of gradation is white, then the predetermined gradation level correction driving pulse data is selected on the basis of the detected temperature and the elapsed time since the previous drawing, and the driving pulse is applied. Therefore, area ghost of white pixel of which level of gradation is not to be transited can be removed without doing flashing.

<Processing Flow of Second Area Ghost Removing Processing>

The first area ghost removing processing explained above is an example where the area ghost removing processing is performed only on white pixels. Subsequently, an example will be explained in a case where the area ghost removing processing is performed on pixels of multiple levels of gradation including white pixels.

Figure 9:
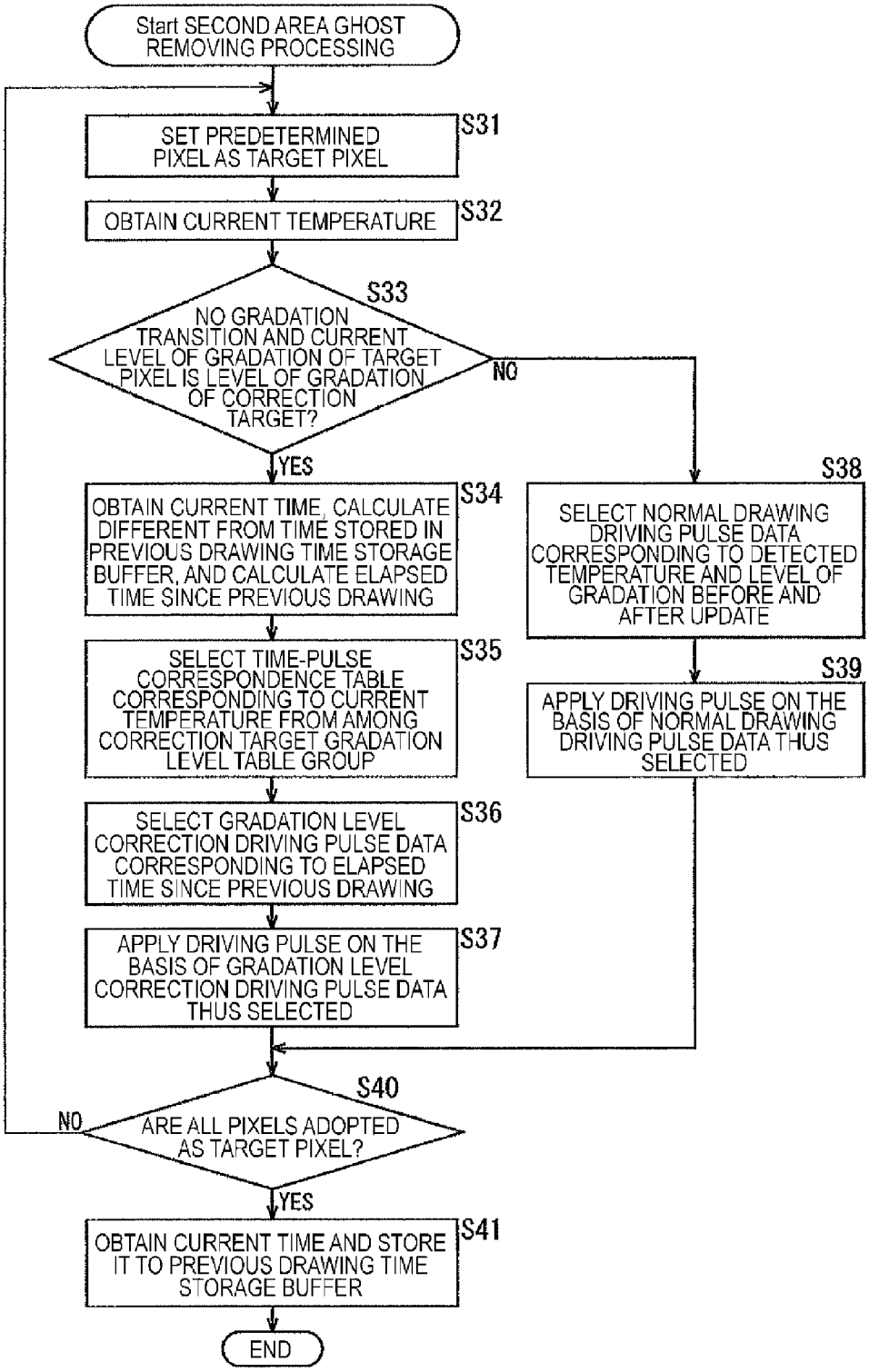
FIG. 9 is a flowchart for explaining second area ghost removing processing.

FIG. 9 is a flowchart of second area ghost removing processing for performing area ghost removing processing on pixels of multiple levels of gradation including white pixels.

This processing is executed in a case where, for example, the operation detection unit 16 provides request of drawing. In the explanation below, like FIG. 8, suppose that a user performs operation to turn a page, and the operation detection unit 16 provides a request of drawing for updating a page.

First, in step S31, the control unit 12 sets a predetermined pixel of all the pixels of the display 11 as a target pixel which is a pixel of drawing target.

In step S32, the control unit 12 obtains the current temperature detected by the temperature sensor 13.

In step S33, on the basis of the image data stored in the subsequent image buffer 22, the control unit 12 determines whether the level of gradation of the target pixel does not transit between the current page and the subsequent page, and the current level of gradation of the target pixel is the level of gradation of the correction target. For example, when the levels of gradation of white, gray 8, and black are set as the level of gradation of the correction target, a determination in step S33 is made to determine as to whether the level of gradation of the target pixel is not to be transited, and the current level of gradation of the target pixel is any one of white, gray 8, and black.

When the level of gradation of the target pixel is determined not to be transited, and the current level of gradation of the target pixel is determined to be the level of gradation of the correction target in step S33, then the processing in step S34 is subsequently performed.

In step S34, the control unit 12 obtains the current time from the clock 14, calculates difference from the time stored in the previous drawing time storage buffer 26, and calculates the elapsed time since the previous drawing.

In step S35, the control unit 12 selects the time-pulse correspondence table corresponding to the current temperature from the table group of the correction target gradation level.

For example, when the current level of gradation of the target pixel is white, the control unit 12 selects the white pixel time-pulse correspondence table 51*c* corresponding to the current temperature from the white pixel table group 41.

For example, when the current level of gradation of the target pixel is gray X, the control unit 12 selects the gray X time-pulse correspondence table 52*c* corresponding to the current temperature from the gray X table group 42.

Likewise, when the current level of gradation of the target pixel is black, the control unit 12 selects the black pixel time-pulse correspondence table 53*c* corresponding to the current temperature from the black pixel table group 43.

Then, in step S36, the control unit 12 selects the gradation level correction driving pulse data corresponding to the elapsed time since the previous drawing from the selected time-pulse correspondence table.

Subsequently, in step S37, the control unit 12 applies the driving pulse to the target pixel on the basis of the selected gradation level correction driving pulse data. After step S37, subsequently the processing in step S40 is performed.

On the other hand, when the level of gradation of the target pixel is to be transited, or the current level of gradation of the target pixel is determined not to be the level of gradation of the correction target in step S33 explained above, subsequently the processing in step S38 is performed.

In step S38, the control unit 12 selects any one of the normal drawing driving pulse data 1 to the normal drawing driving pulse data N on the basis of the obtained current temperature, the level of gradation of the target pixel before the update, and the level of gradation after the update.

Then, in step S39, the control unit 12 applies the driving pixel corresponding to the selected normal drawing driving pulse data to the target pixel. Thereafter, the processing in step S40 is subsequently performed.

In step S40, the control unit 12 determines whether all the pixels of the display 11 have been set as the target pixel.

When all the pixels are determined not to have been set as the target pixel in step S40, the flow returns back to the processing in step S31, and the processing in steps S31 to S40 explained above are repeated. More specifically, when a subsequent pixel that has not yet been set as the target pixel is set as the target pixel, and the level of gradation of the target pixel is not to be transited, and the level of gradation is the level of gradation of the correction target, then, the control is executed to apply the driving pulse according to the elapsed time since the previous drawing.

On the other hand, when all the pixels are determined to have been set as the target pixel in step S40, subsequently the processing in step S41 is performed, and the control unit 12 obtains the current time from the clock 14, and stores it to the previous drawing time storage buffer 26, and the processing is terminated.

As described above, according to the second area ghost removing processing, each pixel of the display 11 is set as the target pixel, and when the level of gradation is to be transited on the basis of the pixel data displayed subsequently, the driving pulse corresponding to the normal drawing driving pulse data is applied to the target pixel.

On the other hand, when the level of gradation of the target pixel is not to be transited, the level of gradation of the target pixel is identified. Then, a determination is made as to whether the level of gradation of the target pixel is the level of gradation of the correction target or not. When the level of gradation of the target pixel is determined to be the level of gradation of the correction target, the gradation level correction driving pulse data is selected on the basis of the detected temperature and the elapsed time since the previous drawing, and the driving pulse is applied. Accordingly, in the pixels of desired levels of gradation (multiple levels of gradation) where the level of gradation is not to be transited, area ghost can be removed without doing flashing.

<Effects According to This Method>

The effects of the area ghost removing processing performed by the control unit 12 will be hereinafter explained with reference to FIG. 10.

Figure 1:
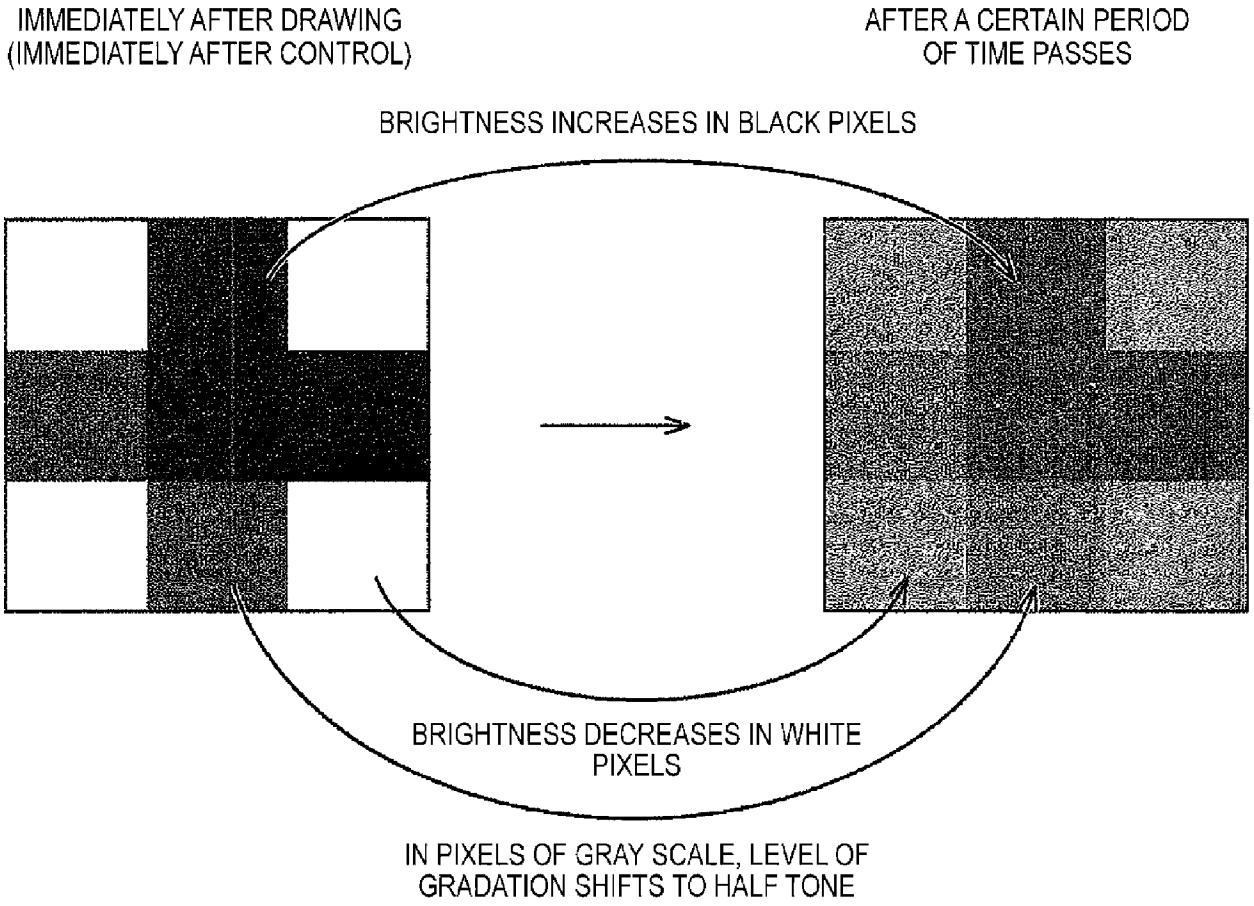
FIG. 1 is a figure for explaining a conventional problem.
Figure 2:
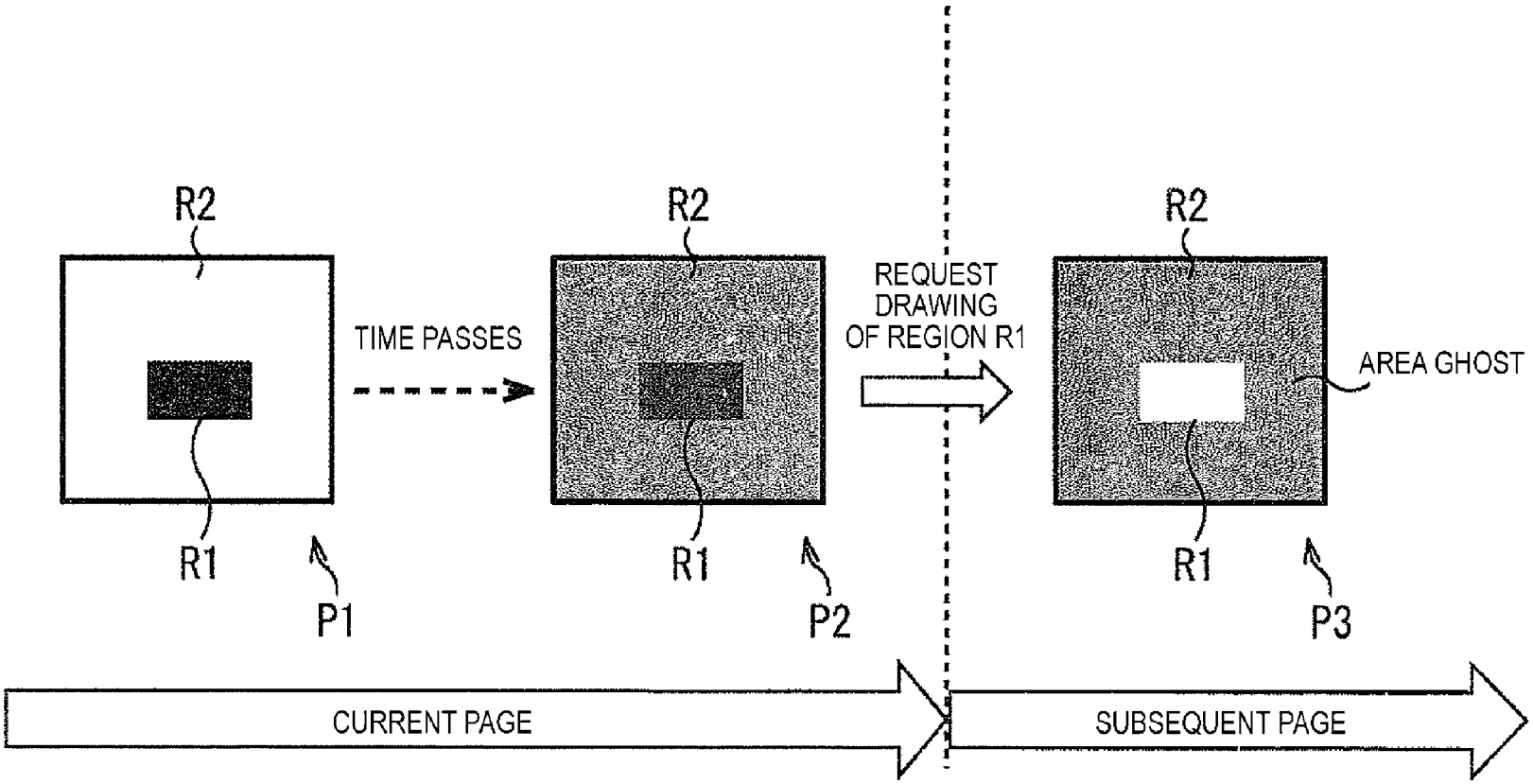
FIG. 2 is a figure for explaining a conventional problem.
Figure 10:
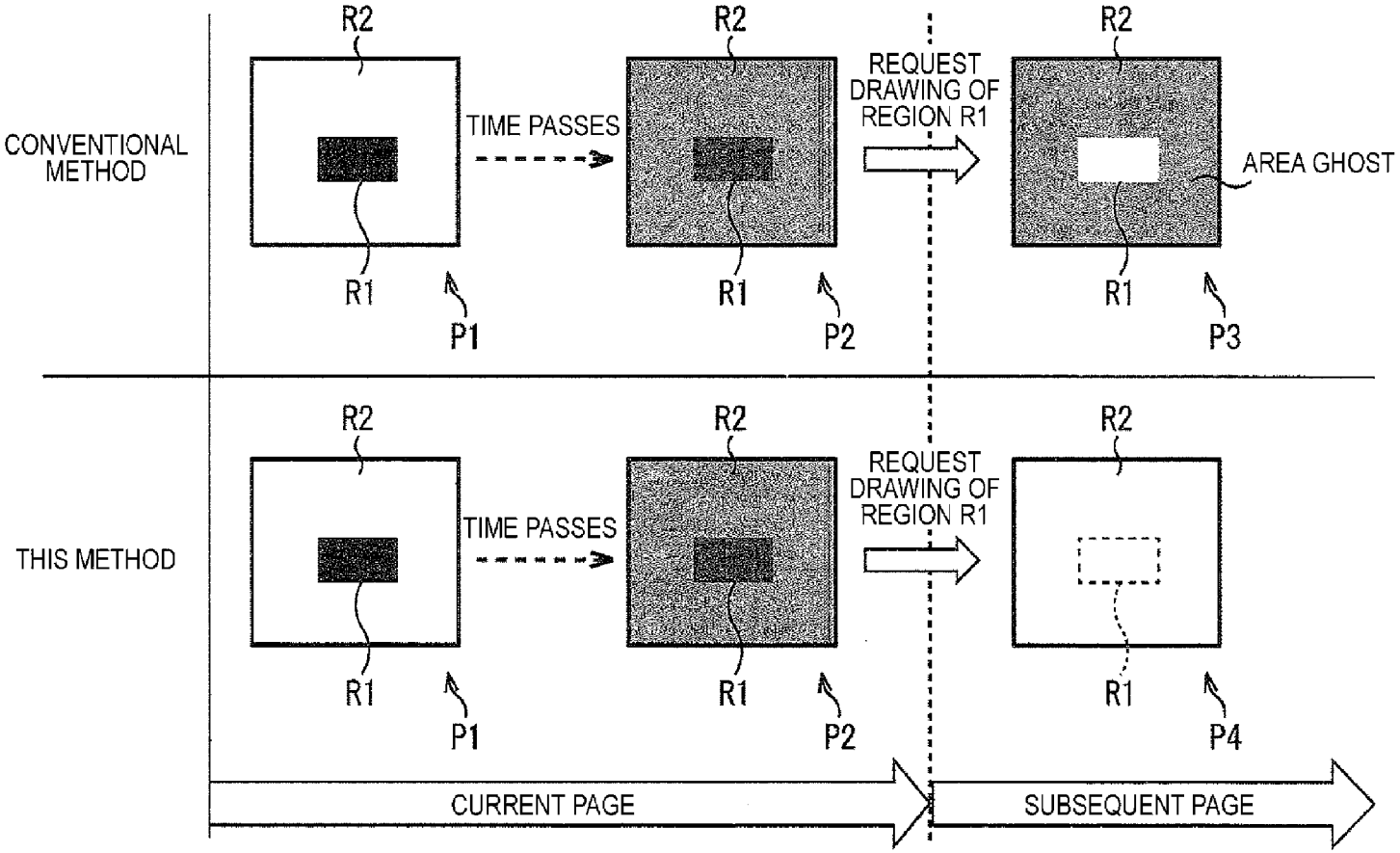
FIG. 10 is a figure for explaining the effects of the area ghost removing processing.

FIG. 10 illustrates a screen display result in a case where the area ghost removing processing (this method) performed by the control unit 12 is executed, as opposed to a screen display result according to the driving method of the conventional control as illustrated in FIG. 2.

When update of drawing from the current page to a subsequent page is requested in the area ghost removing processing performed by the control unit 12, a voltage of driving pulse for returning the change of the level of gradation back to the original state in order to remove area ghost is applied, on the basis of the elapsed time since the previous drawing, even to a region R2 which is a region of white pixel of which level of gradation is not to be transited, as described above. Therefore, this can suppress area ghost that occurs due to the change of the level of gradation caused by the elapse of time, in pixels of which level of gradation is not to be changed originally.

Therefore, as illustrated in the figure at the lower side of FIG. 10, in a screen P4 after the update, there is no difference in the level of gradation between the regions R1 and R2, and the area ghost does not occur. More specifically, a phenomenon that a pixel transits to an undesired level of gradation due to change over time can be alleviated without doing flashing.

In the above example, the pixel of which level of gradation is to be transited and the pixel of which level of gradation is not to be transited are drawn at the same time. However, drawing update control for the pixel of which level of gradation is to be transited and drawing update control for the pixel of which level of gradation is not to be changed that is done in order to remove the area ghost may be separated and can be executed in two steps.

In the above example, timing for updating the entire screen when a page is turned has been explained as an example of timing with which the first and second area ghost removing processing are executed. However, at a time when the entire screen is updated other than the time when a page is turned, the first and second area ghost removing processing can also be executed. For example, in a selection screen for selecting content displayed on the display 11 (electronic book) and a screen update for displaying various kinds of setting screens, the first and second area ghost removing processing can also be executed.

<Explanation About Area Ghost Removing Processing When Screen Does not Transit for a Certain Period of Time or More>

In the first and second area ghost removing processing explained above, the screen may not transit for a certain period of time or more, e.g., when correction of a pixel of which level of gradation is not to be changed is executed with timing for turning a page but a user does not perform operation for turning a page for a certain period of time or more. In such case, the area ghost need to be removed at a time different from the time when the screen is updated.

Therefore, subsequently, area ghost removing processing in a case where the screen is not to be transited for a certain period of time will be explained.

Figure 11:
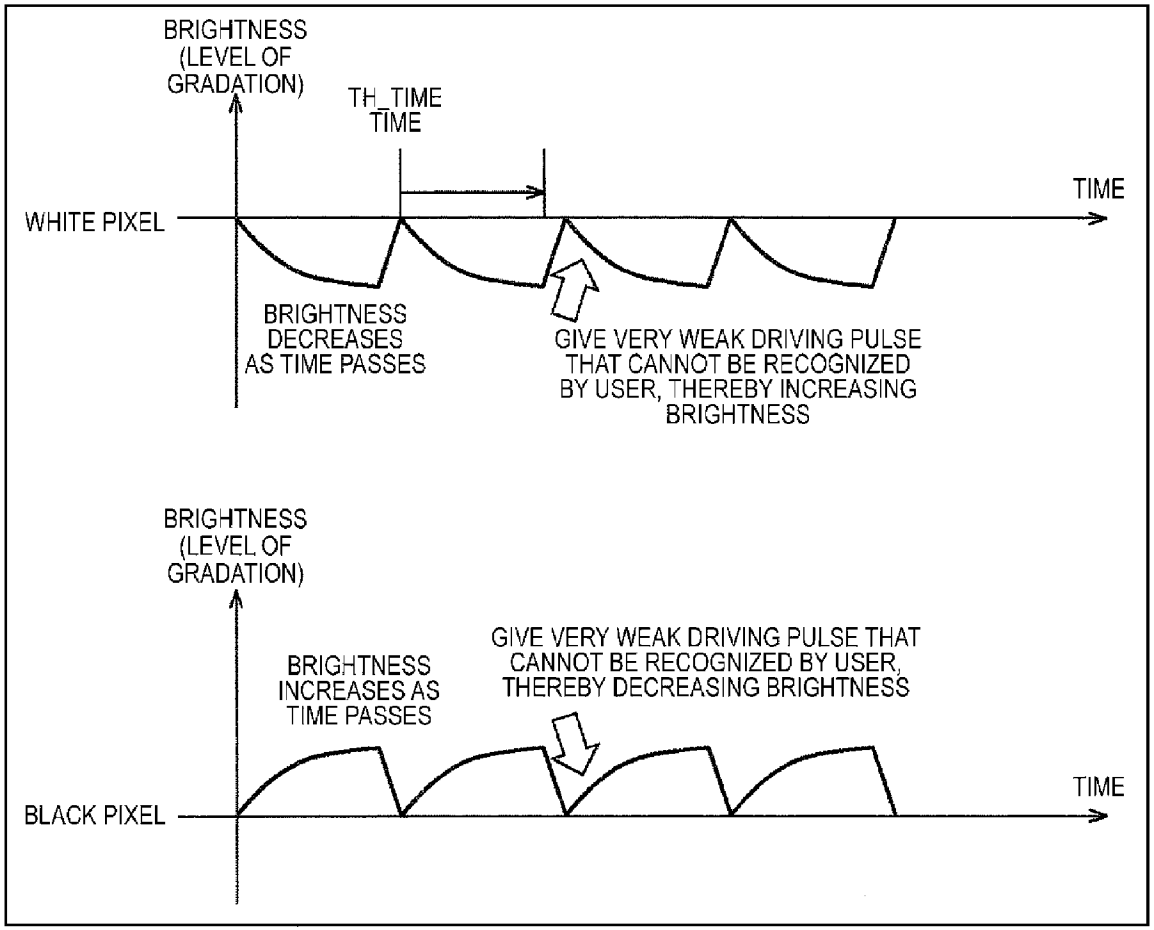
FIG. 11 is a figure for explaining area ghost removing processing where screen transition does not occur for a certain period of time.

FIG. 11 is a figure for explaining the area ghost removing processing in a case where the screen is not to be transited for a certain period of time.

The figure at the upper side of FIG. 11 illustrates an example of area ghost removing processing in a case where the level of gradation of pixels where the screen does not transited for a certain period of time is white.

In the white pixel, when the screen is not updated, the brightness gradually decreases to reach the half tone as the time passes.

The control unit 12 measures a time for which the state in which the screen does not transit continues on the basis of the previous drawing time stored in the previous drawing time storage buffer 26. Then, when the state in which the screen does not transit continues for a certain period of time (time TH_TIME which is a threshold value) or more, the control unit 12 obtains the regular time correction driving pulse data (white to white) corresponding to the current temperature from the regular time correction pulse data storage unit 25, and the driving pulse is applied on the basis of the obtained regular time correction driving pulse data (white to white).

In this case, the time TH_TIME may be set as a time interval with which the user may not recognize degradation of the level of gradation, and the regular time correction driving pulse data may be set as driving pulse for recovering this degradation of the level of gradation.

The figure at the lower side of FIG. 11 illustrates an example of area ghost removing processing in a case where the level of gradation of pixels where the screen does not transit for a certain period of time is black.

In the black pixel, when the screen is not updated, the brightness gradually increases to reach the half tone as the time passes.

The control unit 12 measures a time for which the state in which the screen does not transit continues on the basis of the previous drawing time stored in the previous drawing time storage buffer 26. Then, when the state in which the screen does not transit continues for the period of time (time TH_TIME) or more, the control unit 12 obtains the regular time correction driving pulse data (black to black) corresponding to the current temperature from the regular time correction pulse data storage unit 25, and the driving pulse is applied on the basis of the obtained regular time correction driving pulse data (black to black).

The processing of the gray scale is also the same as the processing for the white pixel and the black pixel which have been explained above.

<Processing Flow of Third Area Ghost Removing Processing>

Figure 12:
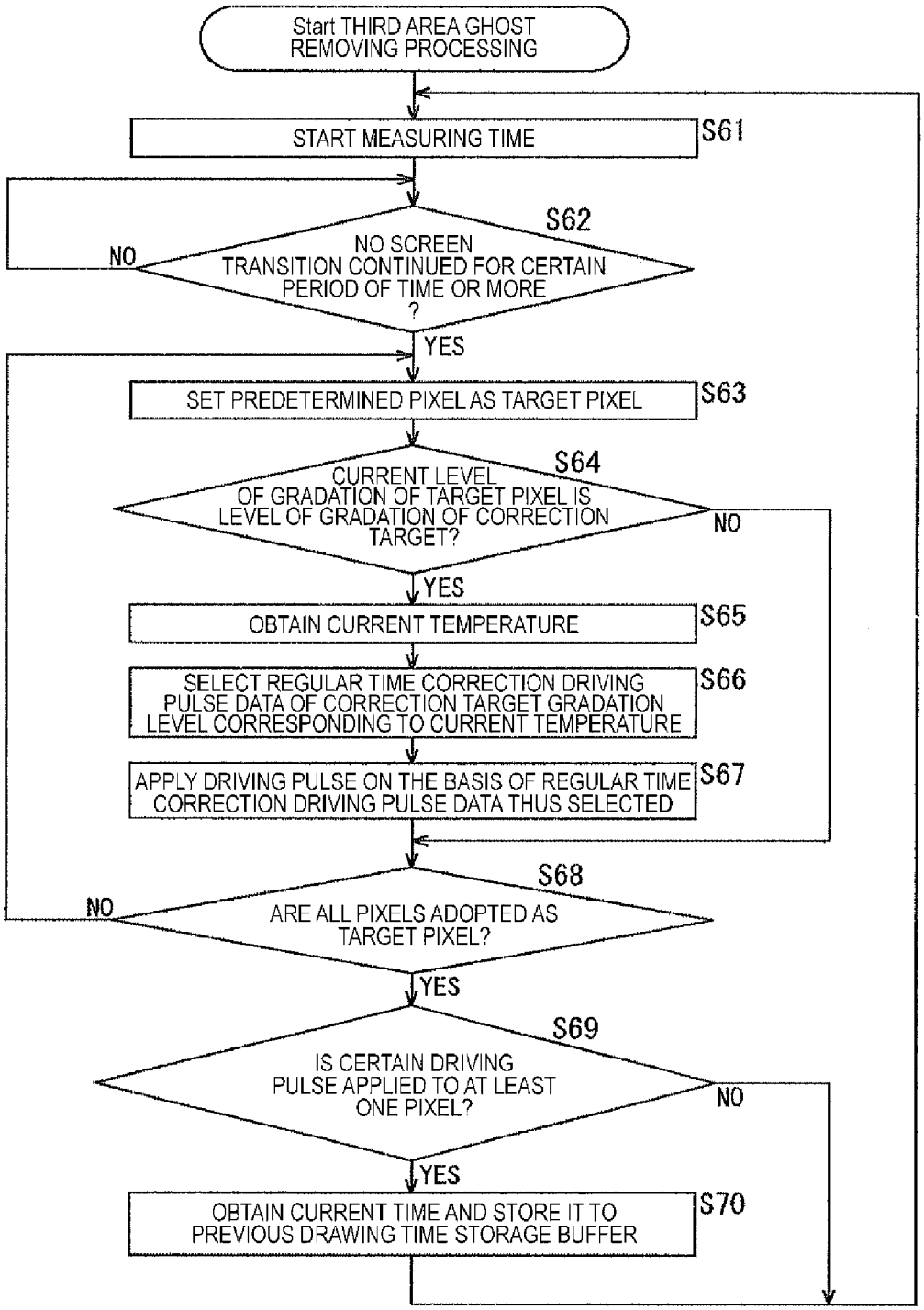
FIG. 12 is a flowchart for explaining third area ghost removing processing.

FIG. 12 is a flow chart of the third area ghost removing processing for correcting the change of the level of gradation in a case where the state in which the screen does not transit continues for a certain period of time.

This processing is started when, for example, the screen is updated in response to turning of a page, and is continuously executed until the screen is subsequently updated.

First, in step S61, the control unit 12 starts measuring a time for which the state in which the screen does not transit continues on the basis of the previous drawing time stored in the previous drawing time storage buffer 26.

In step S62, the control unit 12 determines whether the state in which the screen does not change continues for the period of time (time TH_TIME) or more, and the processing in step S62 is repeated until the control unit 12 determines that the state in which the screen does not transit continues for the period of time (time TH_TIME) or more.

Then, when the state in which the screen does not transit is determined to have continued for the period of time or more in step S62, subsequently the processing in step S63 is performed, and the control unit 12 sets a predetermined pixel of all the pixels of the display 11 as a target pixel which is a pixel of drawing target.

In step S64, the control unit 12 determines whether the current level of gradation of the target pixel is the level of gradation of the correction target. For example, when the level of gradation of the correction target is four kinds of levels of gradation, i.e., white, gray 4, gray 8, and black, then a determination is made as to whether the current level of gradation of the target pixel is any one of white, gray 4, gray 8, and black.

When the current level of gradation of the target pixel is determined not to be the level of gradation of the correction target in step S64, the processing in step S68 explained later is subsequently performed.

On the other hand, when the current level of gradation of the target pixel is determined to be the level of gradation of the correction target in step S64, subsequently the processing in step S65 is performed, and the control unit 12 obtains the detected current temperature with the temperature sensor 13.

In step S66, the control unit 12 selects the regular time correction driving pulse data of the correction target gradation level corresponding to the current temperature. For example, when the current level of gradation of the target pixel is white, the regular time correction driving pulse data (white to white) is selected from the regular time correction driving pulse data group corresponding to the current temperature. For example, when the current level of gradation of the target pixel is gray 4, the regular time correction driving pulse data (gray 4 to gray 4) is selected from the regular time correction driving pulse data group corresponding to the current temperature.

In step S67, the control unit 12 applies the driving pulse to the target pixel on the basis of the selected regular time correction driving pulse data.

In step S68, the control unit 12 determines whether all the pixels of the display 11 are set as the target pixel.

When all the pixels are determined not to have been set as the target pixel in step S68, the flow returns back to the processing in step S63, and the processing in steps S63 to S68 explained above are repeated on a subsequent target pixel.

On the other hand, when all the pixels are determined to have been set as the target pixel in step S68, subsequently the processing in step S69 is performed, and the control unit 12 determines whether a certain driving pulse is applied to at least one pixel of the display 11.

When the driving pulse is determined not to have been applied to all the pixels in step S69, subsequently the processing in step S61 is performed back again.

On the other hand, when the driving pulse is determined to have been applied to all the pixels in step S69, subsequently the processing in step S70 is performed, and the control unit 12 obtains the current time from the clock 14, and stores it to the previous drawing time storage buffer 26, and thereafter, the flow returns back to the processing in step S61.

As described above, according to the third area ghost removing processing, it is possible to suppress the change of the level of gradation that occurs when the state in which the screen does not transit continues for a certain period of time.

According to the first to the third area ghost removing processing described above, a voltage of driving pulse for returning the change of the level of gradation back to the original state that is caused by the elapse of time is applied to pixels in accordance with the elapsed time since the previous drawing and the current temperature. Therefore, without doing flashing, this can suppress area ghost that occurs due to the change of the level of gradation caused by the elapse of time, in pixels of which level of gradation is not to be changed originally.

In the explanation about the above examples, the electronic book reader 1 has all of the first to third area ghost removing functions and execute them. Alternatively, the electronic book reader 1 may have only one or two of the first to third area ghost removing functions.

In the explanation about the above embodiments, the bi-stable electro-optical display 11 is a display for displaying sixteen levels of monochrome gradation. However, the levels of gradation may be other than sixteen. Alternatively, the bi-stable electro-optical display 11 may be a display capable of color display.

In the explanation about the above embodiments, for example, the present technology is applied to the electronic book reader. However, the present technology is not limited to those for electronically displaying information about books. The present technology can be applied to any electronic information display apparatus in general that electronically displays information such as other characters, figures, and images.

The embodiments of the present technology are not limited to the above embodiments. The embodiments of the present technology can be changed in various manners without deviating from the gist of the present technology.

For example, a mode in which all or some of multiple processing explained above are combined may be employed.

Each step explained with the above flowchart can be executed by one apparatus, or may be executed by multiple apparatuses in a distributed manner.

Further, when multiple processing are included in one step, multiple processing included in one step can be executed by one apparatus, or may be executed by multiple apparatuses in a distributed manner.

It is to be understood that, the steps described in the flowchart of this specification may be performed in time series along with the order described, or may not be necessarily processed in time series, i.e., the steps may be executed in parallel or upon necessity such as when calling is performed.

(1) A device comprising:

circuitry configured to determine a currently defined tone of a pixel, determine a voltage to be applied to the pixel to compensate for a change in tone of the pixel through elapsed time based on the currently defined tone of the pixel, and apply the voltage to the pixel.

(2) The device of (1), wherein the voltage is determined based on the elapsed time.

(3) The device of any one of (1) to (2), wherein the circuitry is configured to remove an area ghost by applying the voltage.

(4) The device of any one of (1) to (3), further comprising:

a display including a plurality of pixels, the pixel being one of the plurality of pixels.

(5) The device of any one of (1) to (4), wherein the circuit determines the elapsed time as a time between a time when the currently defined tone for the pixel is set and a current time.

(6) The device of (5), wherein the circuitry applies a first predetermined pixel voltage when the currently defined tone of the pixel is a first predetermined tone, and applies a second predetermined pixel voltage that is different from the first predetermined pixel voltage when the currently defined tone of the pixel is a second predetermined tone.

(7) The device of any one of (5) to (6), wherein the circuitry applies the voltage after the image displayed on the display remains constant for a predetermined time period.

(8) The device of any one of (5) to (7), wherein the circuitry applies the voltage at a time when the currently defined tone of the pixel changes to another predetermined tone.

(9) The device of (8), wherein the circuitry applies the voltage as a transition between the currently defined tone of the pixel and the other predetermined tone.

(10) The device of any one of (5) to (9), wherein the display is a bi-stable electro-optical display.

(11) The device of any one of (5) to (10), wherein the device is an e-reader.

(12) The device of any one of (5) to (8), wherein the circuitry applies the voltage upon a turning of a page.

(13) The device of (1) to (4), wherein the tone of the pixel corresponds to an image displayed on the display.

(14) The device of (1) to (6), wherein the circuitry stores the first predetermined pixel voltage in a first look-up table indexed by time and stores the second predetermined pixel voltage in a second look-up table indexed by time.

(15) The device of (14), wherein the circuitry selects one of the first or second look-up tables based on the currently defined tone of the pixel.

(16) The device of any of (14) to (15), wherein the first look-up table belongs to a first look-up table group including a plurality of second look-up tables according to temperature, and the second look-up table belongs to a second look-up table group including a plurality of second look-up tables according to temperature.

(17) The device of any of (14) to (16), wherein the circuitry selects the first look-up table from the first look-up table group according to a temperature of the device.

(18) The device of any of (14) to (18), wherein the circuitry selects the second look-up table from the second look-up table group according to a temperature of the device.

(19) The device of any of (14) to (18), wherein the circuitry is further configured to measure temperature.

(20) The device of (17), wherein the circuitry is configured to store the current time as the time when the currently defined tone for the pixel is set.

(21) A method for removing an area ghost in a display of an apparatus, comprising:

determining a currently defined tone of a pixel;

determining a voltage to be applied to the pixel to compensate for a change in tone of the pixel through elapsed time based on the currently defined tone of the pixel; and applying the voltage to the pixel.

(22) A non-transitory computer-readable medium encoded with computer-readable instructions thereon, the computer-readable instructions when executed by a computer cause the computer to perform a method comprising:

determining a currently defined tone of a pixel;

determining a voltage to be applied to the pixel to compensate for a change in tone of the pixel through elapsed time based on the currently defined tone of the pixel; and applying the voltage to the pixel.

(23) A display control apparatus including a control unit configured to calculate an elapsed time since previous drawing in a predetermined pixel of a bi-stable electro-optical display that displays a predetermined level of gradation by applying a voltage corresponding to a driving pulse, and apply a voltage of a predetermined driving pulse to the pixel on the basis of the calculated elapsed time.

(24) The display control apparatus according to (23) further including a gradation level correction driving pulse data storage unit configured to store a time-pulse correspondence table for storing the elapsed time since the previous drawing and driving pulse data that are applied at the elapsed time in association with each other, wherein the control unit selects driving pulse data corresponding to the calculated elapsed time from the time-pulse correspondence table, and on the basis of the selected driving pulse data, a voltage of the predetermined driving pulse is applied to the pixel.

(25) The display control apparatus according to (24), wherein the gradation level correction driving pulse data storage unit has the time-pulse correspondence table for each predetermined temperature, and wherein the control unit obtains the current temperature of the bi-stable electro-optical display, and uses the time-pulse correspondence table corresponding to the current temperature.

(26) The display control apparatus according to (24) or (25), wherein the gradation level correction driving pulse data storage unit has the time-pulse correspondence table for each predetermined level of gradation, and wherein the control unit uses the time-pulse correspondence table corresponding to the level of gradation of the predetermined pixel.

(27) The display control apparatus according to (24), wherein the gradation level correction driving pulse data storage unit has the time-pulse correspondence table for each predetermined temperature for multiple levels of gradation, and wherein the control unit obtains a current temperature of the bi-stable electro-optical display, and uses the time-pulse correspondence table corresponding to the level of gradation of the predetermined pixel and corresponding to the current temperature.

(28) The display control apparatus according to any one of (23) to (27), wherein the predetermined pixel is a pixel of which level of gradation is not to be changed during update of image data which are displayed on the bi-stable electro-optical display.

(29) The display control apparatus according to claim any one of (23) to (28), wherein the control unit applies a voltage of the predetermined driving pulse to the predetermined pixel of which level of gradation is not to be changed when a page is turned on the bi-stable electro-optical display.

(30) The display control apparatus according to any one of (23) to (29), wherein the predetermined pixel is a pixel where image data displayed on the bi-stable electro-optical display is not updated for a certain period of time or more.

(31) A display control method for a display control apparatus configured to control display of a bi-stable electro-optical display that displays a predetermined level of gradation by applying a voltage corresponding to a driving pulse, the display method including a step of calculating an elapsed time since previous drawing in a predetermined pixel of the bi-stable electro-optical display, and applying a voltage of a predetermined driving pulse to the pixel on the basis of the calculated elapsed time.

(32) An electronic information display apparatus including:

a bi-stable electro-optical display configured to display a predetermined level of gradation by applying a voltage corresponding to a driving pulse; and a control unit configured to calculate an elapsed time since previous drawing in a predetermined pixel of the bi-stable electro-optical display, and applies a voltage of a predetermined driving pulse to the pixel on the basis of the calculated elapsed time.

(33) A display control apparatus including a control unit configured such that, for a predetermined pixel of bi-stable electro-optical display configured to display a predetermined level of gradation by applying a voltage corresponding to a driving pulse, a level of gradation when the pixel is previously drawn is identified, and a voltage of driving pulse which causes the same level of gradation as the identified level of gradation is applied to the pixel.

(34) A display control method for a display control apparatus configured to control display of a bi-stable electro-optical display that displays a predetermined level of gradation by applying a voltage corresponding to a driving pulse, the display method including a step of, for a predetermined pixel of the bi-stable electro-optical display, identifying a level of gradation when the pixel is previously drawn, and applying, to the pixel, a voltage of driving pulse which causes the same level of gradation as the identified level of gradation.

(35) An electronic information display apparatus including:

a bi-stable electro-optical display configured to display a predetermined level of gradation by applying a voltage corresponding to a driving pulse; and a control unit configured to, for a predetermined pixel of the bi-stable electro-optical display, identify a level of gradation when the pixel is previously drawn, and apply, to the pixel, a voltage of driving pulse which causes the same level of gradation as the identified level of gradation.

(36) A display control apparatus including a control unit configured to, for a predetermined pixel of the bi-stable electro-optical display that displays a predetermined level of gradation by applying a voltage corresponding to a driving pulse, identify a level of gradation when the pixel is previously drawn, and apply, to the pixel, a voltage of driving pulse for removing area ghost.

(37) A display control method for a display control apparatus configured to control display of a bi-stable electro-optical display configured to display a predetermined level of gradation by applying a voltage corresponding to a driving pulse, the display control method including a step of, for a predetermined pixel of the bi-stable electro-optical display, identify a level of gradation when the pixel is previously drawn, and apply, to the pixel, a voltage of driving pulse for removing area ghost.

(38) An electronic information display apparatus including:

a bi-stable electro-optical display configured to display a predetermined level of gradation by applying a voltage corresponding to a driving pulse; and a control unit configured to, for a predetermined pixel of the bi-stable electro-optical display, identify a level of gradation when the pixel is previously drawn, and apply, to the pixel, a voltage of driving pulse for removing area ghost.

It should be understood by those skilled in the art that various modifications, combinations, sub-combinations and alterations may occur depending on design requirements and other factors insofar as they are within the scope of the appended claims or the equivalents thereof.

REFERENCE SIGNS LIST

1 Electronic book reader
11 Bi-stable electro-optical display
12 Control unit
13 Temperature sensor
14 Clock
15 Storage unit
16 Operation detection unit
23 Normal drawing pulse data storage unit
24 Gradation level correction pulse data storage unit
25 Regular time correction pulse data storage unit
26 Previous drawing time storage buffer

The invention claimed is:

1. A device, comprising:

a storage unit configured to store a drawing time, wherein the drawing time indicates a time when a display of the device was updated; and circuitry configured to:

determine a first tone of a pixel, wherein the first tone of the pixel indicates a first level of brightness of the pixel;

calculate a difference between a first time and the stored drawing time, wherein the first time is associated with the first tone of the pixel;

determine a voltage for an application to the pixel based on the difference between the first time and the stored drawing time, wherein the voltage compensates for a change in the first tone of the pixel through an elapsed time; and apply the voltage to the pixel in response to detection of a request, wherein the request is to update the display of the device.

2. The device according to claim 1, wherein the circuitry is further configured to determine the voltage based on the elapsed time.

3. The device according to claim 1, wherein the circuitry is further configured to remove an area in the display based on the application of the voltage to the pixel.

4. The device according to claim 1, further comprising:

the display including a plurality of pixels, wherein the pixel is one of the plurality of pixels.

5. The device according to claim 1, wherein the circuitry is further configured to determine the elapsed time as a time duration between the first time at which the first tone for the pixel is set and a second time at which the request is received.

6. The device according to claim 5, wherein the circuitry is further configured to:

apply a first pixel voltage based on the pixel of the first tone; and apply a second pixel voltage based on the pixel of a second tone, wherein the first pixel voltage is different from the second pixel voltage.

7. The device according to claim 5, wherein the circuitry is further configured to apply the voltage after an image displayed on the display remains constant for a time period.

8. The device according to claim 5, wherein the circuitry is further configured to apply the voltage at a third time, wherein the first tone of the pixel changes to a second tone.

9. The device according to claim 8, wherein the circuitry is further configured to apply the voltage as a transition between the first tone of the pixel and the second tone of the pixel.

10. The device according to claim 5, wherein the display is a bi-stable electro-optical display.

11. The device according to claim 5, wherein the device is an e-reader.

12. The device according to claim 8, wherein the circuitry is further configured to apply the voltage based on the request, and wherein the request is to turn a page displayed on the display.

13. The device according to claim 4, wherein the first tone of the pixel corresponds to an image displayed on the display.

14. The device according to claim 6, wherein the circuitry is further configured to store the first pixel voltage in a first look-up table indexed by time and store the second pixel voltage in a second look-up table indexed by time.

15. The device according to claim 14, wherein the circuitry is further configured to select one of the first look-up table or the second look-up table based on the first tone of the pixel.

16. The device according to claim 14, wherein the first look-up table belongs to a first look-up table group, wherein the first look-up table group includes a plurality of first look-up tables based on a first temperature of the display, wherein the second look-up table belongs to a second look-up table group, and wherein the second look-up table group includes a plurality of second look-up tables based on a second temperature of the display.

17. The device according to claim 16, wherein the circuitry is further configured to select the first look-up table from the first look-up table group based on a third temperature of the device.

18. The device according to claim 16, wherein the circuitry is further configured to select the second look-up table from the second look-up table group based on a third temperature of the device.

19. The device according to claim 16, wherein the circuitry is further configured to measure a third temperature of the device.

20. The device according to claim 17, wherein the circuitry is further configured to store the first time, and wherein the first tone of the pixel is set at the first time.

21. A method, comprising:

in a device comprising:

storing a drawing time, wherein the drawing time indicates a time when a display of the device was updated;

determining a first tone of a pixel, wherein the first tone of the pixel indicates a first level of brightness of the pixel;

calculating a difference between a first time and the stored drawing time, wherein the first time is associated with the first tone of the pixel;

determining a voltage for an application to the pixel based on the difference between the first time and the stored drawing time, wherein the determined voltage compensates for a change in the first tone of the pixel through an elapsed time; and applying the voltage to the pixel in response to detection of a request, wherein the request is to update the display of the device.

22. A non-transitory computer-readable medium having stored thereon computer-executable instructions, which when executed by a computer cause the computer to execute operations, the operations comprising:

storing a drawing time, wherein the drawing time indicates a time when a display was updated;

determining a first tone of a pixel, wherein the first tone of the pixel indicates a first level of brightness of the pixel;

calculating a difference between a first time and the stored drawing time, wherein the first time is associated with the first tone of the pixel;

determining a voltage for an application to the pixel based on the difference between the first time and the stored drawing time, wherein the determined voltage compensates for a change in the first tone of the pixel through an elapsed time; and applying the voltage to the pixel in response to detection of a request, wherein the request is to update the display.

* * * * *